US005211046A

United States Patent [19]

Inagaki

[11] Patent Number: 5,211,046

[45] Date of Patent: May 18, 1993

[54] METHOD FOR FORMING MULTISTAGE HOLLOW PIPE

[75] Inventor: Masayuki Inagaki, Ibaraki, Japan

[73] Assignee: Kyosan Denki Kabushiki Kaisha, Tokyo, Japan

[21] Appl. No.: 700,344

[22] Filed: May 7, 1991

Related U.S. Application Data

[63] Continuation of Ser. No. 475,129, Feb. 2, 1990, abandoned.

[30] Foreign Application Priority Data

Feb. 6, 1989 [JP] Japan ..... 1-26971

[51] Int. Cl.[5] ..... B21D 15/06

[52] U.S. Cl. ..... 72/306; 72/305; 72/311; 72/357; 72/367; 72/370

[58] Field of Search ..... 72/306, 316, 295, 305, 72/311, 58, 59, 367, 370, 369, 357

[56] References Cited

U.S. PATENT DOCUMENTS

| | | | |
|---|---|---|---|
| 616,764 | 12/1898 | Bourke | 72/354 |
| 2,541,869 | 2/1951 | Grant | 72/59 |
| 2,581,787 | 1/1952 | Dreyer | 72/322 |
| 2,759,379 | 8/1956 | Brandt | 72/354 |
| 3,864,956 | 2/1975 | Barry | 72/354 |
| 4,289,007 | 9/1981 | Kraft | 72/59 |
| 4,319,471 | 3/1982 | Benteler | 72/62 |

FOREIGN PATENT DOCUMENTS

| | | | |
|---|---|---|---|
| 48430 | 4/1980 | Japan | 72/61 |
| 144827 | 6/1988 | Japan | 72/306 |
| 855891 | 12/1960 | United Kingdom | 72/62 |

*Primary Examiner*—Daniel C. Crane

*Attorney, Agent, or Firm*—Flynn, Thiel, Boutell & Tanis

[57] ABSTRACT

An apparatus of and a method for forming a multistage hollow pipe comprising the steps of arranging a hollow pipe on a plurality of molds composed of an upper mold, first, second, third forming molds for subjecting the hollow pipe to drawing process, axially applying a compressive force, which is greater than the force forming multistage bulges on the hollow pipe, to the hollow pipe for forming the multistage hollow pipe, removing the processed multistage hollow pipe and other molds from the first forming mold, releasing the clamping of the processed multistage hollow pipe by the second and the third forming molds, and taking out the processed multistage hollow pipe.

1 Claim, 5 Drawing Sheets

METHOD FOR FORMING MULTISTAGE HOLLOW PIPE

This application is a continuation of U.S. Ser. No. 07/475,129, filed Feb. 2, 1990, now abandoned.

BACKGROUND OF THE INVENTION

1. Field of the Invention

The present invention relates to a method of and an apparatus for forming multistage hollow pipe, namely, for forming multistage bulges and spools on the hollow pipe.

2. Prior Art

The simplest method to buckle a hollow pipe is by fixing the hollow pipe by a plurality of molds and applying a compressive force to the hollow pipe in a punching press or a drawing press. In this method, there is required an apparatus for returning the plurality of molds to their own positions for carrying out the next step at the time of buckling or pressing the hollow pipe, namely, at the time when the molds are moved simultaneously with the buckling of the hollow pipe.

However, if the molds are to be returned immediately after the completion of the buckling of the hollow pipe, and if at least three bulges or spools are formed on the hollow pipe, the molds can not return to their own positions because the bulges or spools formed on the hollow pipe impede the return of the molds. If the molds are forced to be returned, the molds damage the bulges or spools. There arises the problem set forth above even if a spring is employed, although it has been employed in most cases, for returning the molds since it is liable to return immediately after releasing the compressive force applied to the hollow pipe.

In view of the problems set forth above, a plurality of steps are conventionally taken for forming at least three bulges or spools on the hollow pipe without taking these steps simultaneously.

SUMMARY OF THE INVENTION

It is therefore an object of the present invention to provide a method and an apparatus for forming multistage hollow pipe capable of drawing the pipe at one step to form multistage bulges and spools on the hollow pipe without damaging the multistage bulges and spools on the hollow pipe by moving the molds.

To achieve the above object, the method of and the apparatus for forming the multistage hollow pipe comprises steps of arranging a hollow pipe on a plurality of molds composed of an upper mold, first, second, third forming molds for subjecting the hollow pipe to drawing process, axially applying a compressive force, which is greater than the force forming multistage bulges on the hollow pipe, to the hollow pipe for forming the multistage hollow pipe, removing the processed multistage hollow pipe and other molds from the first forming mold, releasing the clamping of the processed multistage hollow pipe by the second and the third molds, and taking out the processed multistage hollow pipe.

The above and other objects, features and advantages of the present invention will become more apparent from the following description taken in conjunction with the accompanying drawings.

DESCRIPTION OF THE PREFERRED EMBODIMENT

Figure 1:
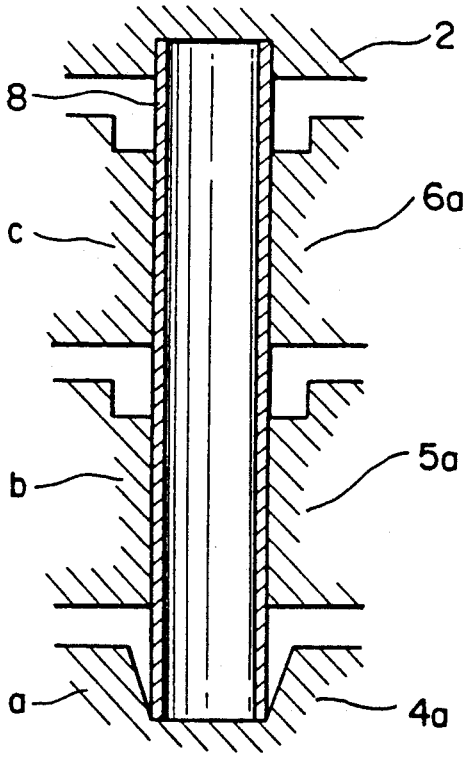
FIG. 1 is a cross sectional view of assistance in explaining the relation between a hollow pipe and molds before the hollow pipe is subjected to a drawing process.
Figure 2:
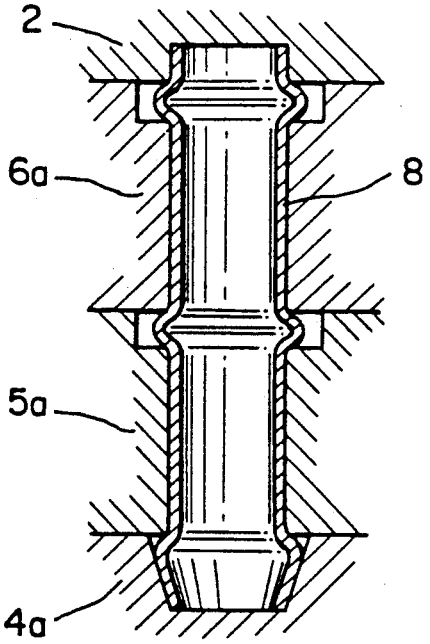
FIG. 2 is a cross sectional view of assistance in explaining the relation between the hollow pipe and molds after the hollow pipe is subjected to the drawing process.

A principle of a method of and an apparatus for forming multistage hollow pipe will be described with reference to FIGS. 1 and 2.

The principle resides in that a compressive force, which is greater than the limit of the strength for buckling a hollow pipe 8, is axially applied to a hollow pipe 8 while the upper and lower ends of the hollow pipe 8 are fixed on an upper mold 2 and a first forming mold 4*a* for thereby swelling or bulging the hollow pipe 8 in the circumferential direction. In the case that three multistage bulges are formed on the hollow pipe 8, the molds (a), (b), (c) are layered in this order while the predetermined intervals are spaced between the molds (a), (b), (c) as illustrated in FIG. 1, and then the compressive force is axially applied to the hollow pipe 8. As a result, the multistage hollow pipe 8 is formed as illustrated in FIG. 2.

A preferred embodiment will be described with reference to FIGS. 3 to 6.

In the same figure, designated at 1 are guide shafts mounted on a table 4*c*. A holding plate 9 is slidably engaged with the guide shafts 1. The holding plate 9 has an upper mold 2 at its lower surface and a tip end of a piston rod of a hydraulic cylinder 3 at its upper surface.

The table 4*c* has a first forming mold 4*a* which is embedded therein, guide plates 10 which are vertically mounted thereon provided with stoppers 4*g*, 4*h*, and pistons 4*d* which are embedded therein and urged upwardly by springs 4*e*.

The first forming mold 4*a* has a bottom on which a pin 4*b* for guiding a hollow pipe 8 is vertically mounted.

Figure 3:
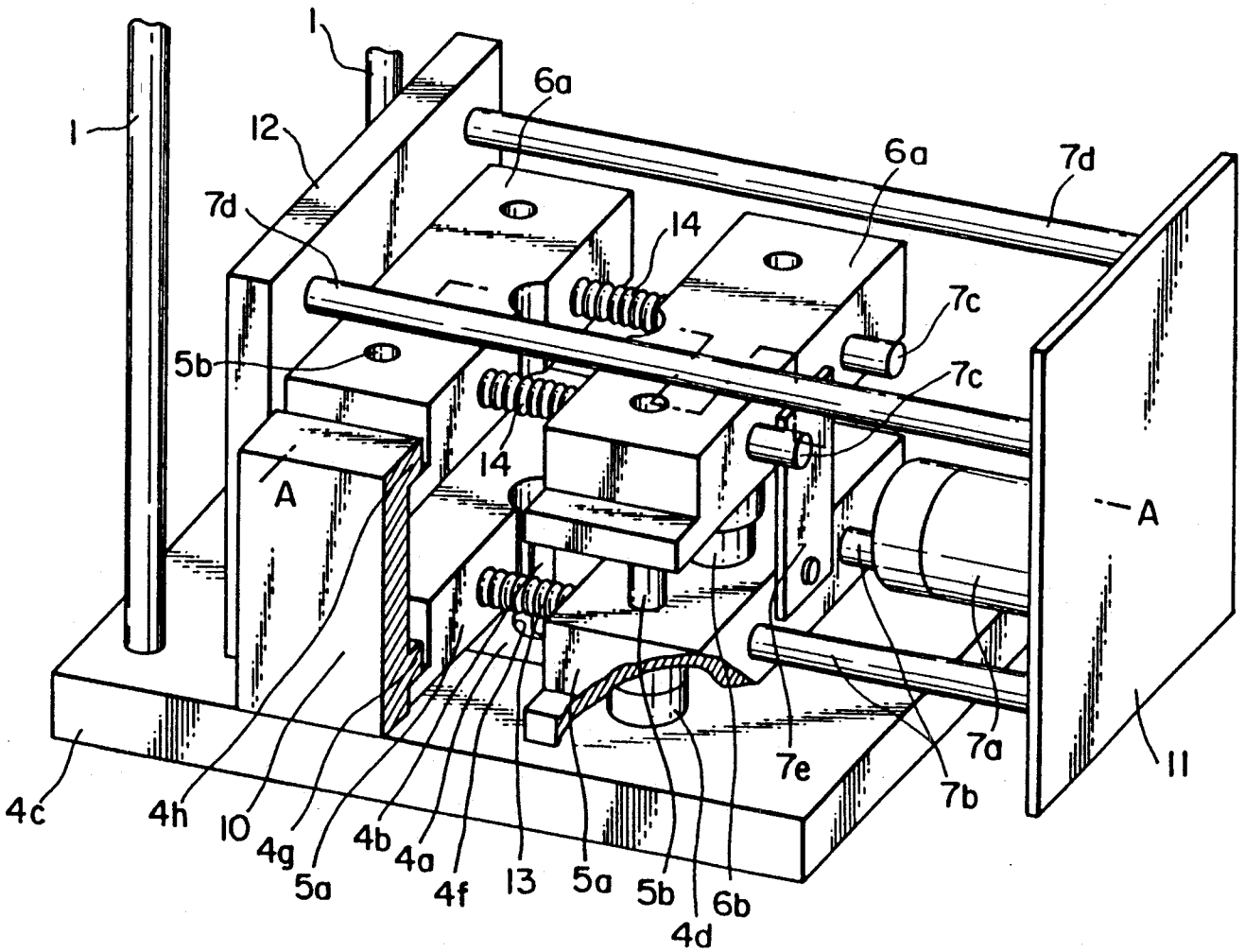
FIG. 3 is a perspective view of assistance in explaining movement of molds.

Second forming mold 5*a* and third forming mold 6*a* are respectively split type molds as shown in FIG. 3 and arranged over the first forming mold 4*a*. That is, the second forming mold 5*a* and the third forming mold 6*a* are respectively composed of two split molds. The split molds of the second forming mold 5*a* are penetrated by shaft 7*b* both ends of which are coupled with coupling plates 11, 12. The coupling plates 11, 12 are also coupled by supporting rods 7*d*. Shafts 7*c* are fixed to one of the split molds of the third forming mold 6*a* (left split mold 6*a* in FIG. 3) which penetrate the other split mold (right split mold in FIG. 3). Springs 13, 14 are provided on the shafts 7b, 7c between the split molds of the second forming mold 5a, and between the split molds of the third forming mold 6a. The second and third forming molds 5a, 6a respectively have forming portions 5c, 6c at their upper surfaces. The tip end of a piston 4d is to be brought into contact with each lower surface of the second forming mold 5a and a tip end of a piston rod of a pneumatic cylinder 6b disposed in the third forming mold 6a is to be brought into contact with the second forming mold 5a.

Guide shafts 5b are fixed on the second forming mold 5a and the third forming mold 6a are vertically movable along the shafts 5b. One of two split molds of the second and the third forming molds 5a, 6a (each right mold in FIG. 3) are to be moved laterally at the same time by a hydraulic cylinder 7a fixed to the coupling plate 11. Designated at 7e is a caul fixed to one of the split molds of the second forming mold 5a and movable relative to one of the split molds of the third forming mold 6a. The caul 7e is provided for preventing one of the split molds (each right mold in FIG. 3) of the second and the third forming molds 5a, 6a from being moved relative to the guide shaft 5b in the space or clearance defined between an outer one of the split molds (each right mold in FIG. 3) of the second and the third forming molds 5a, 6a in the case the piston of the hydraulic cylinder 7a can not press completely one of the split molds of the second forming mold 5a and one of the split molds of the third forming mold 6a (right split molds in FIG. 3) when the hollow pipe 8 is clamped by the second forming split mold 5a and the third forming split mold 6a with use of the hydraulic cylinder 7a.

A method of forming the multistage hollow pipe will be described hereinafter.

Figure 4:
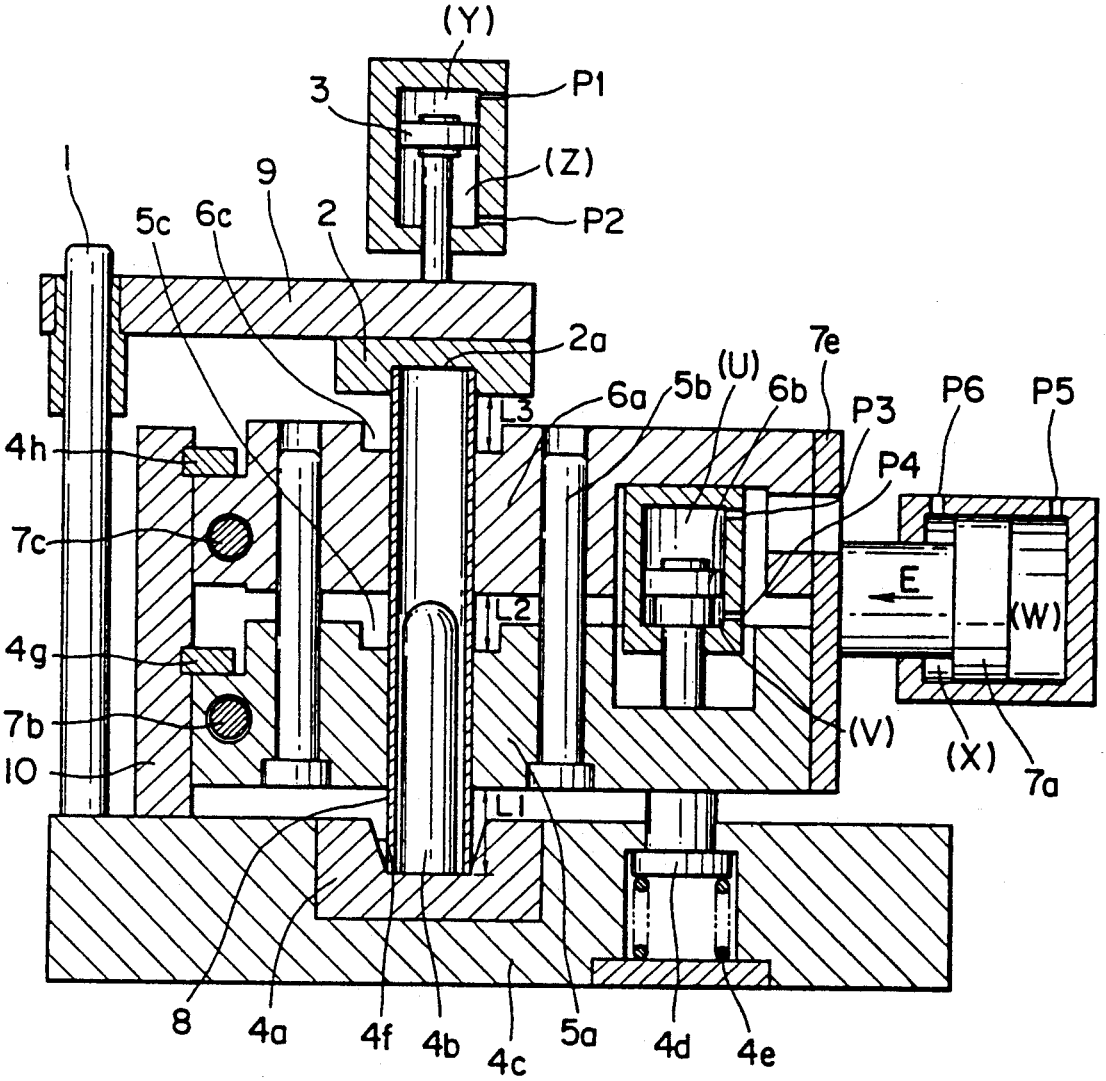
FIG. 4 is a cross sectional view of an apparatus for forming multistage hollow pipe before the hollow pipe is subjected to the drawing process along lines A—A of FIG. 3.

With the arrangement of the apparatus as illustrated in FIG. 3, firstly, the hollow pipe 8 is inserted into the guide pin 4b and supported on a bottom surface of the first forming portion 4f of the first forming mold 4a. Secondly, an oil under pressure P5 is supplied to a chamber (W) of the hydraulic cylinder 7a whereby the force in the direction of the arrow E (in FIG. 4) is applied to each one of the split molds of the second and the third forming molds 5a , 6a through the caul 7e. Each one of the split molds of the second and the third forming molds 5a, 6a is guided by the shafts 7t, 7c and moved toward each of the other split molds of the second and third forming molds 5a, 6a whereby both the split molds of the second and the third forming molds 5a, 6a clamp the hollow pipe 8 as illustrated in FIG. 4. With this state, oil under pressure P1 is supplied to a chamber (Y) of the hydraulic cylinder 3 to lower the upper mold 2 for allowing the end surface 2a of the upper mold 2 to be brought into contact with the end portion of the hollow pipe 8 and pressing the hollow pipe 8 downward. Hence, the compressive force is applied to the hollow pipe 8 for thereby subjecting the hollow pipe to the drawing process at three portions as denoted 4f, 5c, 6c, namely, forming the three bulges on the hollow pipe 8.

A process of forming the multistage hollow pipe will be described with reference to FIG. 6.

There are clearances (6d) between the outer diameter (d) of the hollow pipe 8 and each pipe clamping diameter (d') of the upper mold 2, the second forming mold 5a, and the third forming mold 6a. When the compressive force is applied to the hollow pipe 8, the hollow pipe 8 is bulged from the central portion thereof. If the compressive force is further applied to the hollow pipe 8, the diameter of the hollow pipe 8 is brought into contact with the pipe clamping diameter (d'), namely, the hollow pipe 8 is brought into contact with the second and the third forming molds 5a, 6a. The intervals L1, L2, L3 between the first, second and third forming molds 4a, 5a, 6a become the size required for forming the multistage pipe.

Figure 6A:
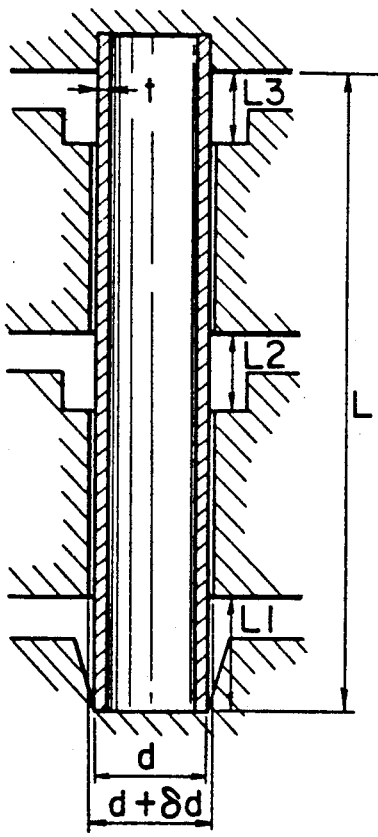
FIGS. 6*a* and 6*b* are cross sectional views of assistance in explaining clearances between the molds and the hollow pipe.
Figure 6B:
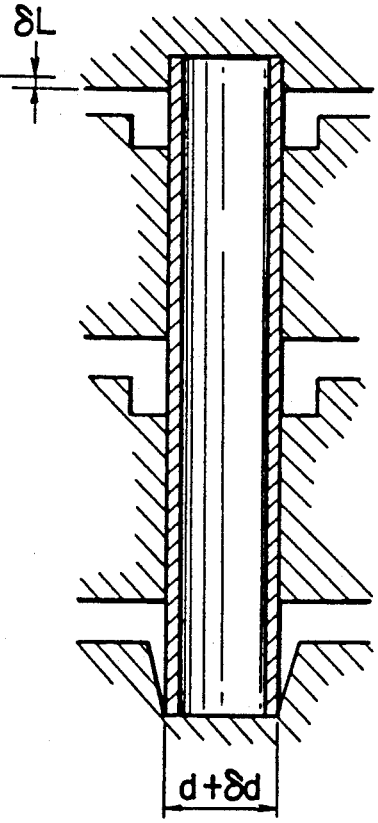

When the compressive force is applied to the hollow pipe 8 from the state as illustrated in FIG. 6(*a*), the outer peripheral portion of the hollow pipe 8 expand into contact with the inner peripheral portions of the first, second and third forming molds 4a, 5a, 6a whereby the hollow pipe 8 is shortened for the amount of compressive force. This is expressed in the following theoretical formula:

$$\delta L = \frac{\delta d \times L}{d + \delta d - t}$$

where outer diameter of the hollow pipe 8 is d, length of the hollow pipe is L, thickness of the hollow pipe is t, diameters of the first, second and third forming, molds are $d+\delta d=d'$ and the amount of the compressive force $\delta L$.

Hence, the amount of length variation of the hollow pipe 8 becomes greater as $\delta d$ becomes greater or the pipe is longer. On the basis of the theoretical formula, the value of the intervals L1, L2, L3 are determined. If the compressive force is further applied to the hollow pipe 8, the second forming mold 5a, the third forming mold 6a are lowered so that the intervals L1, L2, L3 are varied. This is caused by the buckling operation and determined by the Rankine equations. That is, the bulge of the hollow pipe 8 first occurs at the longest intervals among the L1, L2 and L3.

Figure 5:
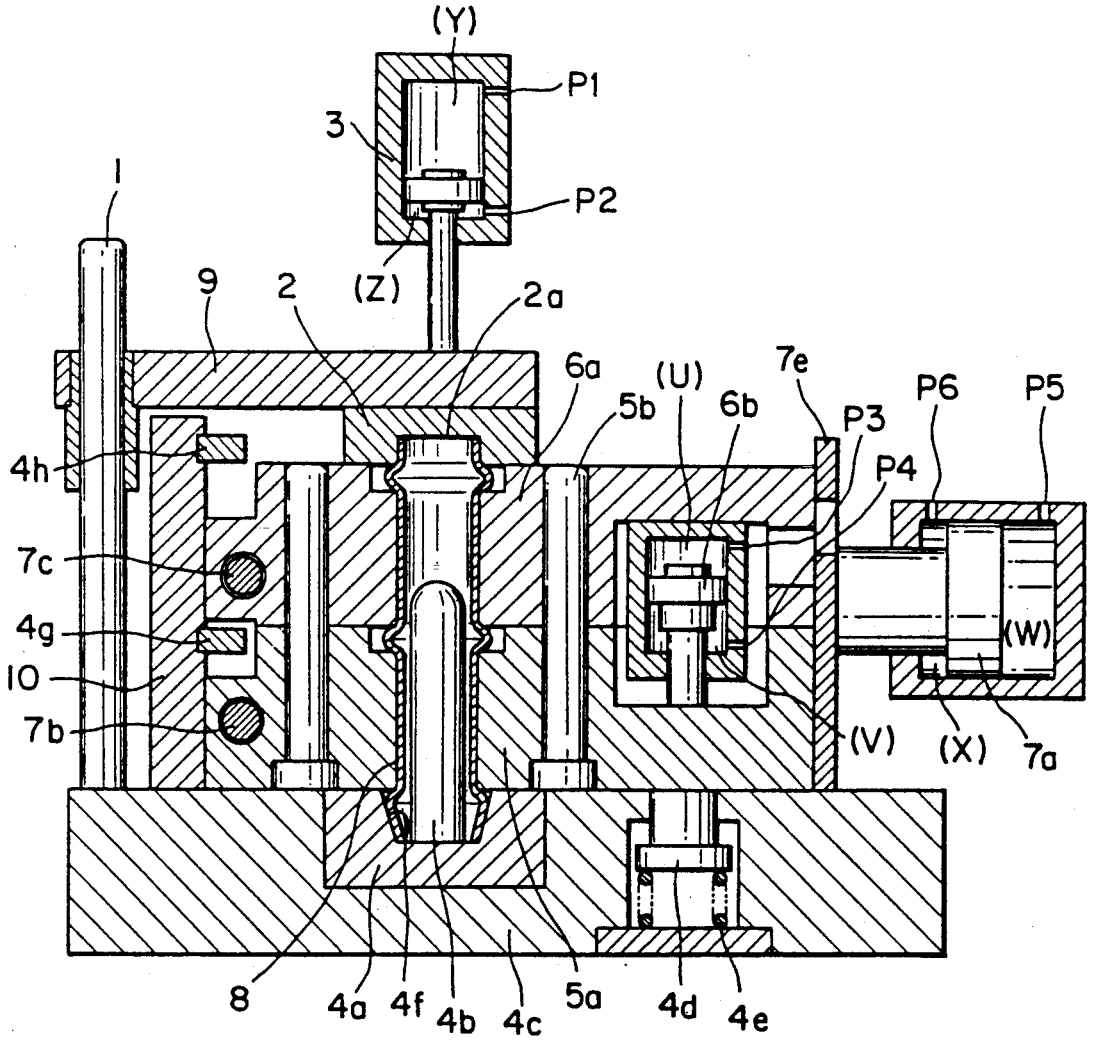
FIG. 5 is a cross sectional view of an apparatus for forming multistage hollow pipe after the hollow pipe is subjected to the drawing process along lines A—A of FIG. 3.

Consequently, according to the embodiment of the present invention, the bulges are formed sequentially in the order of the intervals L3, L1 and L2 and the multistage hollow pipe is formed as illustrated in FIG. 5. At this time, the third forming mold 6a is lowered without any obstacle since there is established the relation between the air under pressure P3 in a chamber (U) of the pneumatic cylinder 6b and the oil under pressure P1 in the chamber (Y) of the hydraulic cylinder 3 expressed as (U)<(Y). The forming process is thus completed.

A return process will be described hereinafter.

An oil under pressure P2 is supplied to a chamber (Z) of the hydraulic cylinder 3 from the state as illustrated in FIG. 5 to raise the upper mold 2. At this time, inasmuch as the oil under pressure P5 in the chamber (W) of the hydraulic cylinder 7a is not released and the air under pressure P3 is remained in the chamber (U) of the pneumatic cylinder 6b, the second forming mold 5a and the third forming mold 6a are moved away, or raised from the first forming mold 4a due to the upward movement of the upper mold 2 and the pressing force of the piston 4d caused by the springs 4e while the tip end of the piston rod of the pneumatic cylinder 6b remains in contact with the second forming mold 5a and the second forming mold 5a and the third forming mold 6a remain in contact with each other, whereby the multistage hollow pipe 8 is kept clamped.

When the second forming mold 5a is brought into contact with the stopper 4g, raising operations of both the second and the third forming molds 5a, 6a are stopped. Successively, when an oil under pressure P6 is supplied to a chamber (X) of the hydraulic cylinder 7a, the split molds of the second and third forming molds 5*a*, 6*a* are opened while the second and the third forming molds 5*a*, 6*a* are brought into contact with each other whereby the hollow pipe 8 is released from the clamping by the second and the third forming molds 5*a*, 6*a* and the hollow pipe 8 remains inserted into the guide pin 4*b*.

When the hollow pipe 8, after being subjected to the drawing process, is taken out from the apparatus and the air under pressure P3 is supplied to the chamber (U) of the pneumatic cylinder 6*b*, the tip end of the piston rod of the pneumatic cylinder 6*b* pushes the second forming mold 5*a*, whereby only the third forming mold 6*a* slides along the guide shafts 5*b* and moves upward by the repulsive force relative to the force applied to the second forming mold 5*a* and comes into contact with the stopper 4*h*. At this time, if the supply of the air under pressure P3 to the chamber (U) of the pneumatic cylinder 6*b* is stopped, the raising operation of the third forming mold 6*a* is stopped so that the first forming mold 4*a*, the second forming mold 5*a*, the third forming mold 6*a* and the upper mold 2 are returned to their initial positions as illustrated in FIG. 3, whereby the process for forming the multistage hollow pipe is completed.

As mentioned above, according to the present invention, it is possible to subject the hollow pipe to the drawing process at one step without damaging the hollow pipe per se due to movement of the molds for thereby forming the multistage hollow pipe. Hence, it is possible to reduce the process time of forming the multistage hollow pipe and the cost for manufacturing the apparatus.

Although the invention has been described in its preferred form with a certain degree of particularity, it is to be understood that many variations and changes are possible in the invention without departing from the scope thereof.

What is claimed is:

1. An apparatus for forming multistage hollow pipe comprising:

a plurality of molds arranged in generally vertical relationship and including an upper old positioned vertically above a first forming mold, a second forming mold and a third forming mold as disposed in vertically ascending order, said second and hired forming molds being split and composed of relatively movable mold parts, said plurality of molds being disposed in predetermined spaced relationship and defining an upwardly opening mold cavity for receiving a hollow pipe;

a first pressure cylinder for pressing the hollow pipe downward with an open lower end of the hollow pipe abutting downwardly against the first mold;

a second pressure cylinder for moving the split mold parts of the second and third forming molds and for clamping the hollow pipe therein;

vertical biasing means cooperating with as said first, second and third forming molds for creating vertical spaced intervals between adjacent said molds;

stopper means for stopping upward movement of each of the second and third forming molds independently of the other, including fist and second separate and independent stopped positioned for contacting respective upwardly facing surfaces of said second and third molds during upward movement thereof; and a guide pin mounted on the first forming mold for guiding the hollow pipe, said guide pin being received in the open lower end of the hollow pipe when the hollow pipe is positioned in the mold cavity;

wherein said apparatus is free of means for producing a pressure differential between the interior and exterior of the hollow pipe.

* * * * *

UNITED STATES PATENT AND TRADEMARK OFFICE

CERTIFICATE OF CORRECTION

PATENT NO. : 5,211,046

DATED : May 18, 1993

INVENTOR(S) : Masayuki Inagaki

It is certified that error appears in the above-identified patent and that said Letters Patent is hereby corrected as shown below:

Column 6, line 5; change "old" to ---mold---.
line 8; change "hired" to ---third---.
line 20; delete "as".
line 25; change "fist" to ---first---.
line 26; change "stopped" to ---stoppers---.

Signed and Sealed this

Twelfth Day of April, 1994

Bruce Lehman

*Attest:*

BRUCE LEHMAN

*Commissioner of Patents and Trademarks*

*Attesting Officer*